United States Patent [19]

Spencer et al.

[11] 4,307,966

[45] Dec. 29, 1981

[54] PRINTER WIRE FOR PRINTER WIRE ASSEMBLY, ASSEMBLY AND METHOD FOR PRODUCING SAME

[75] Inventors: James R. Spencer, Sayre; Harry D. Martin, Jr., Troy, both of Pa.

[73] Assignee: GTE Products Corporation, Stamford, Conn.

[21] Appl. No.: 102,587

[22] Filed: Dec. 11, 1979

[51] Int. Cl.[3] ..... B41J 3/12

[52] U.S. Cl. ..... 400/124; 101/93.05

[58] Field of Search ..... 400/124; 101/93.05; 219/85 A, 85 M, 118; 228/208, 209, 210

[56] References Cited

U.S. PATENT DOCUMENTS 3,296,693 1/1967 Carter ..... 228/209 X 4,011,981 3/1977 Danna et al. ..... 228/208

4,223,826 9/1980 Usui ..... 228/209 X

FOREIGN PATENT DOCUMENTS 51-107251 9/1976 Japan ..... 228/208

*Primary Examiner*—Paul T. Sewell

*Attorney, Agent, or Firm*—Robert E. Walter

[57] ABSTRACT

Printer wire assemblies for dot matrix printers are characterized by a copper layer on the tungsten wire extending beyond the base portion inside the pin socket, to protect the wire from the embrittling effects of brazing, by braze-forming layers on the copper layer and by a blind-hole pin socket, to enable ease of assembly and braze-bonds of uniformly adequate mechanical strength.

11 Claims, 5 Drawing Figures

PRINTER WIRE FOR PRINTER WIRE ASSEMBLY, ASSEMBLY AND METHOD FOR PRODUCING SAME

BACKGROUND FOR THE INVENTION

This invention relates to printer wire for printer wire assemblies used in dot matrix printers, and more particularly relates to an improved copper-covered printer wire, and to assemblies thereof, and to a method for producing them.

Dot matrix printers have the capability of high speed printing, useful, for example, in producing computer print-outs. Characters such as letters and numerals are formed by an array of dots printed on the print-out sheet by selective electronic activation of an array of printer wires.

The printer wires are fabricated from an impact and wear-resistant material such as tungsten, tungstenrhenium alloy or tungsten carbide, and each is supported by a steel pin or armature, the pin or armature defining a hole or socket for receiving a base portion of the wire. One method of forming the wire-pin assembly involves drilling a hole through the steel pin to accomodate a base portion of the wire and then enlarging a portion of the hole to accommodate a braze preform. The wire and braze preform are then inserted into the pin from opposite sides. Brazing is accomplished by induction heating the assembly to melt the braze and allow it to flow between the wire and hole wall.

A disadvantage of this method is that use of a through hole leads to the impact of printing being entirely absorbed by the braze. It is also difficult to fixture the assembly for brazing, since the pin, wire and braze preform must all be maintained in the proper relative positions by the fixture.

A problem encountered in the use of tungsten printer wire is that the brazing operation tends to lead to wire embrittlement, and consequent premature failure of wire assemblies during printing.

SUMMARY OF THE INVENTION

Printer wire assemblies for dot matrix printers utilize printer wires, each having a base portion covered with a layer of copper alloy and supported by a pin or armature. A blind hole or socket in the pin or armature receives the base portion of the copper-covered wire, and a braze-bond layer between the wire and the socket wall secures the assembly. Extension of the copper layer beyond the blind-hole or socket minimizes embrittlement of the wire otherwise observed to occur as a result of brazing.

In one embodiment, there is provided a tungsten or tungsten alloy printer wire having at least a base portion covered with copper alloy and at least one layer of a braze or braze-forming composition. The assembly is then formed by inserting the base portion of the wire into the socket, and heating the entire assembly to form the braze bond.

The covering of the base portion of the wire with the braze layer or braze-forming layers, together with the use of a blind hole or socket in the pin or armature, enable easy fixturing of assembly, for brazing, as well as mechanical integrity of the brazed assembly, whereby in operation the impact of printing is absorbed primarily by the pin or armature, rather than by the braze.

DETAILED DESCRIPTION OF THE INVENTION

Figure 1:
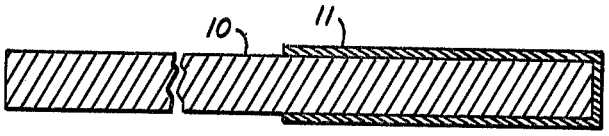
FIG. 1 is one embodiment of a printer wire having a base portion covered with a layer of copper alloy.

Referring now to FIG. 1, there is shown one embodiment of a printer wire 10 having at least a base portion covered with a layer 11 of copper alloy.

For convenience, the term "alloy" is used herein to include an element, eg., copper or tungsten, having from 0 to 50 weight percent of one or more alloying additions.

The printer wire is of an impact-resistant and wear-resistant material, such as a tungsten alloy (e.g., tungsten or tungsten-rhenium) or tungsten carbide. Of these materials, tungsten is currently preferred for its economy. The copper alloy layer may be formed conveniently by electro-plating, although other techniques may be utilized, so long as they result in an adherent layer of relatively uniform thickness, e.g., electroless plating, vapor deposition or cladding. The thickness of the layer is not critical, but must be sufficient to protect the wire from any embrittling effects of the subsequent brazing operation. By way of example, copper alloy layers from 0.00005 inches to 0.0005 inches in thickness have been found satisfactory on tungsten wires of 0.014 inches in diameter.

Figure 2:
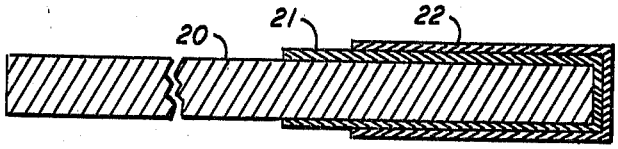
FIG. 2 is another embodiment of a printer wire having a braze-forming layer on the base portion of the copper alloy layer.

Referring now to FIG. 2, there is shown another embodiment of a copper alloy-covered printer wire wherein the base portion, i.e., that portion which will be inserted into the socket of the pin or armature to form the printer wire assembly, is covered with a layer 22 of a braze composition or element or composition which upon heating will alloy with at least a portion of the copper alloy layer 21 to form a braze. Suitable braze compositions are well-known, but could include, for example, a silver solder, nickel-boron self-fluxing alloy, or gold alloy. The thickness of the braze layer is not critical, thicknesses of 0.0003 inches to 0.001 inches having been found satisfactory to form assemblies from 0.014 inches diameter wires. The base portions of such wires are typically about 0.08 inches to 0.25 inches, or 2–12 percent of the total length of the wires.

Figure 3:
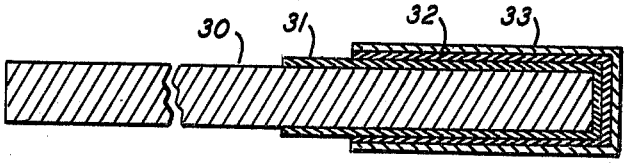
FIG. 3 is still another embodiment of a printer wire having two braze-forming layers on the base portion of the copper alloy layer.
Figure 4:
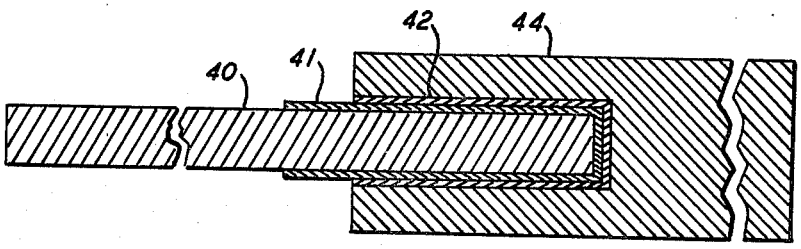
FIG. 4 is one embodiment of a printer wire assembly having a copper-covered printer wire braze-bonded to a pin.
Figure 5:
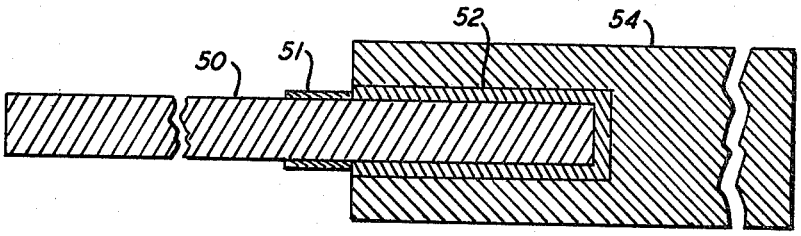
FIG. 5 is another embodiment of a printer wire assembly having a printer wire braze-bonded to a pin, wherein the base portion of the copper layer has been incorporated into the braze, while the remainder of the copper layer extends beyond the pin.

Referring now to FIG. 3, there is shown another embodiment of the printer wire of FIG. 2, wherein separate layers 32 and 33 of braze-forming elements or compositions cover the base portion of copper alloy layer 31. Upon heating, such layers alloy with each other to form a braze. Depending upon their composition, such layers may also at least partially alloy with layer 31 to form a braze. For example, layer 32 may be silver, and layer 33 may be zinc. Upon heating, the zinc layer melts and alloys with the silver layer to form a silver solder braze. In addition to $Z_n$, tin may also be used as a low melting or fluxing element in the in-situ formation of a braze. In will be appreciated that depending upon the brazing composition, the temperature and time of brazing, some or all of the copper alloy layer may be alloyed with the braze. FIGS. 4 and 5 show braze-bonded printer wire assemblies in which the copper alloy layer 41 remains at least partially intact in the embodiment of FIG. 4, but has been completely alloyed in the base portion in the embodiment of FIG. 5. Thus, only that portion 51 which extends beyond pin 54 remains intact in the embodiment of FIG. 5.

The preferred method of forming the layers of copper alloy and braze or braze-forming layers on the printer wire is by successive electroplating. These electroplated layers may be closely controlled in thickness so that the base portion of the wire fits snugly into the socket of the pin or armature and makes substantial contact with the wall of the socket. Such an arrangement avoids complex fixturing to maintain the pin in proper alignment during brazing, and assures the proper amount of braze for a braze bond of uniformly adequate mechanical strength. Brazing is then conveniently accomplished by heating the entire assembly, e.g., by induction heating, to melt the braze and form the braze bond.

While there has been shown and described what are at present considered the preferred embodiments of the invention, it will be obvious to those skilled in the art that various changes and modifications may be made therein without departing from the scope of the invention as defined by the appended claims.

INDUSTRIAL APPLICABILITY

Printer wire assemblies described herein are useful in dot matrix printers for high speed computer print-outs.

We claim:

1. A printer wire for a printer wire assembly comprising a wire having a base portion, a layer of copper alloy covering said base portion, and a braze covering at least a portion of said layer of copper alloy, said braze comprising a layer of silver and a layer of zinc or tin over said silver.

2. The printer wire of claim 1 wherein the copper alloy layer extends from one end of the wire to a distance about 2–12 percent of the total length of the wire.

3. The printer wire of claim 1 wherein the copper alloy layer is from 0.00005 inches to 0.0005 inches in thickness.

4. The printer wire of claim 1 wherein the wire is tungsten.

5. The printer wire of claim 1 wherein the braze extends from one end of the wire to a distance about 2–6 percent of the total length of the wire, and the copper alloy extends beyond the braze.

6. A method of forming a printer wire assembly comprising a printer wire having a base portion, means for supporting the wire defining a socket for receiving the base portion, and a braze-bond layer between the base portion of the wire and the wall of the socket, the method comprising;

(a) forming a copper alloy layer on at least the base portion of he printer wire;

(b) forming a braze on the copper alloy over the base portion of the printed wire, said braze comprising a layer of silver and a layer of zinc or tin over said silver;

(c) inserting the base portion of the printer wire into the socket; and (d) brazing the base portion of the printer wire to the wall of the socket to form a printer wire assembly.

7. The method of claim 6 wherein the printer wire is tungsten.

8. The method of claim 6 wherein the copper alloy layer is formed on the printer wire to extend beyond the base portion thereof.

9. The method of claim 6 wherein the layers are formed by electroplating.

10. The method of claim 6 wherein brazing is carried out by heating the assembly to at least the melting point of the lowest melting braze-forming layer.

11. The method of claim 10 wherein heating is carried out by induction heating.

* * * * *